US008073171B2

(12) United States Patent
Haenggi et al.

(10) Patent No.: US 8,073,171 B2
(45) Date of Patent: Dec. 6, 2011

(54) METHOD FOR MAKING A WIRELESS COMMUNICATION LINK, ANTENNA ARRANGEMENT AND HEARING DEVICE

(75) Inventors: Stefan Haenggi, Murten (CH); Herbert Baechler, Meilen (CH)

(73) Assignee: Phonak AG, Stafa (CH)

( * ) Notice: Subject to any disclaimer, the term of this patent is extended or adjusted under 35 U.S.C. 154(b) by 1232 days.

(21) Appl. No.: 11/366,135

(22) Filed: Mar. 2, 2006

(65) Prior Publication Data

US 2007/0217637 A1 Sep. 20, 2007

(51) Int. Cl.
*H04R 25/00* (2006.01)

(52) U.S. Cl. ..... 381/315; 381/312; 381/23.1

(58) Field of Classification Search ..... 381/23.1, 381/312, 315, 320, 321, 331; 455/115.1, 455/550.1; 600/559; 607/55–57
See application file for complete search history.

(56) References Cited

U.S. PATENT DOCUMENTS

| | | | | |
|---|---|---|---|---|
| 5,548,825 | A * | 8/1996 | Maemura et al. | 455/115.1 |
| 2007/0009124 | A1 * | 1/2007 | Larsen | 381/315 |
| 2009/0245551 | A1 * | 10/2009 | Nielsen | 381/315 |

FOREIGN PATENT DOCUMENTS

| | | | |
|---|---|---|---|
| JP | 08161655 | A | 6/1996 |
| JP | 2001010264 | A | 1/2001 |
| WO | 2004110099 | A2 | 12/2004 |

OTHER PUBLICATIONS

U.S. Appl. No. 11/168,704, filed Jun. 2005, Roeck.
European Search Report, EP06004199, Jul. 26, 2006.

* cited by examiner

*Primary Examiner* — Huyen D Le
(74) *Attorney, Agent, or Firm* — Pearne & Gordon LLP

(57) ABSTRACT

So as to adapt an antenna arrangement (13) for RF-signal transmission in a hearing device (5) to different needs of different types of signal-transmission, the bandwidth BW of the antenna arrangement (13) is manually (M) and/or automatically (A) adjusted.

13 Claims, 5 Drawing Sheets

Figure 1:
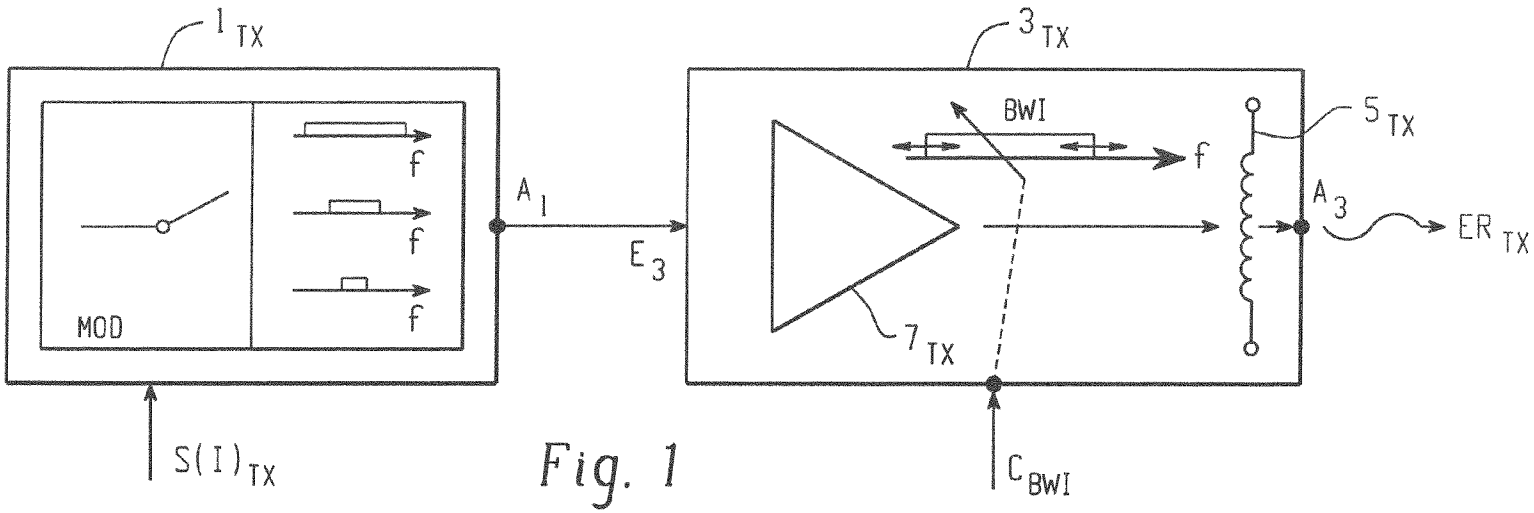

METHOD FOR MAKING A WIRELESS COMMUNICATION LINK, ANTENNA ARRANGEMENT AND HEARING DEVICE

The present invention resides in the field of wireless communication towards or from a hearing device.

Definitions

We understand under "a hearing device" a device which is worn at least adjacent to an individual's ear with the object to improve individual's acoustical perception. Such improvement may also be baring acoustical signals from being perceived, in the sense of hearing protection for the individual.

A hearing device may further be a device to positively improve individual's acoustical perception whether such individual has an impaired perception or not.

If the hearing device is tailored so as to improve the perception of a hearing impaired individual, then we speak of a hearing-aid device.

With respect to the application area a hearing device may especially be applied behind the ear, in the ear or even completely in the ear canal. Accordingly the requirements with respect to compactness of construction become more and more severe.

When we speak of a "wireless communication link" we address a communication link which is based on RF in the frequency range with a lower end at about 10 kHz and up to the higher GHz range, according to today's and future technologies.

When we speak of a "modulator" we understand that unit at which information is brought into a form to be electrically transmitted, e.g. is modulated on an electrical or optical carrier. A modulator has a communication output. At a "demodulator" information is retrieved from a form carried by an electrical or optical signal as applied to a communication input.

We understand under an "antenna arrangement", signal processing and transmission units downstream the communication output of a modulator or upstream a communication input of a demodulator. The upstream front-end of an antenna arrangement assigned to a demodulator and the downstream front-end of such arrangement assigned to a modulator is an antenna. The antenna arrangement converts input electromagnetic radiation into wire bound electric or optical communication signals or vice versa. A single antenna arrangement may be provided for a single antenna receiver/transmitter arrangement.

We understand under a "transfer characteristic" of a unit or of multiple units the ratio of output to input signals, represented over frequency as a magnitude graph and as a phase graph. An example of such representation is the "Bode" diagram representation.

We understand under a "passive electronic" element a resistor, capacitor or inductor. A unit built up from such elements is called a passive unit We understand under "audio signal transmission" via the addressed wireless communication link the transmission of signals which represent generically audio signals corresponding to acoustical signals which impinge on an acoustical/electrical input converter of at least one hearing device involved in the communication link.

We understand under "speech transmission" the transmission of audio-signals as addressed above, in the frequency band of about 70 Hz to 7 kHz.

We understand under "music transmission" the transmission of audio-signals as addressed above over substantially the entire spectral band of human hearing (ca. 20 Hz up to near 20 KHz).

We understand under "command or control signal transmission" the transmission of signals of relatively short duration for controlling purposes. Accurate detection and thus high signal to noise ratio is important.

We understand under "wide or ultra wide band transmission" the transmission of signals which necessitates a bandwidth which is at least 20% of the centre frequency or at least 500 MHz (see UWB tutorial under: www.palowireless.com/uwb).

We understand under "narrow or ultra-narrow band transmission" the transmission of signals the spectrum of which necessitates less than 20% bandwidth of the centre (carrier) frequency or less than 500 MHz.

We understand under "low range transmission" the transmission over and including a distance below 1 m.

We understand under "medium range transmission" the transmission between 1 m and 10 m (both limits included).

We understand under "long range transmission" the signal-transmission over a distance which is longer than 10 m.

We understand under a "type of signal" a category of signals which necessitate a specific bandwidth for their transmission.

In analogy we understand under a "type of transmission" transmission of the respective type of signal, thus having the bandwidth as required.

In today's hearing device technology there is an increasing need to establish wireless communication links towards and from hearing devices. Such communication links are e.g. device-to-device communication links in binaural hearing systems which are characterized especially by features such as near individual's head, short-range, high information flow. Further communication links are e.g. links to remote control units, links to other hearing devices at other individual's to establish hearing device based communication networks as e.g. disclosed in application EP-A-05 013 793.4 or U.S. patent Ser. No. 11/168,704.

Very restricted constructional space is present in hearing devices to apply antenna arrangements. Electric power consumption of the device is a parameter of predominant concern.

The present invention resides on the object of providing the possibility at a hearing device to establish multiple type wireless communication links and to flexibly adapt to such different communication link types.

This is achieved by the method of making a wireless communication link between a hearing device and at least one further device wherein the hearing device has a demodulator and/or a modulator, respectively with a communication input and a communication output the input and/or output is or are operationally connected to a respective antenna arrangement converting input electromagnetic radiation into wire bound electric communication signals and vice versa respectively, the antenna arrangement has a transfer characteristic magnitude which is larger than a predetermined value in a spectral band which has a bandwidth, and comprising the step of adapting the addressed bandwidth to the specific type of momentary established signal transmission or of signal transmission to be established next.

By adapting the addressed bandwidth of the antenna arrangement to the respective specific type of signal to be communicated, it becomes possible to optimize accuracy of the communication link e.g. with respect to signal-to-noise ratio, further e.g. under the constraint of optimum power consumption on the transmission and/or on the receiver side.

In one embodiment of the method the antenna arrangement comprises a passive antenna unit and adapting the bandwidth comprises adjusting the transfer characteristic of the passive antenna unit.

In one embodiment the addressed type of signal transmission is automatically recognized and the bandwidth of the antenna arrangement is automatically adapted.

In a further embodiment the addressed communication link is made between a hearing device and at least one further hearing device.

Thereby the addressed at least two hearing devices are in a further embodiment part of a binaural hearing device system.

When considering which type of signal transmission might lead to adaptation of the bandwidth of the respective antenna arrangements involved in the addressed communication link, in one embodiment such specific types may comprise at least one of Audio signal transmission;
Speech transmission;
Music transmission;
Command or control signal transmission;
Wide- or ultra wide band transmission;
Narrow- or ultra narrow band transmission;
Low range transmission;
Medium range transmission;
Long range transmission.

An antenna arrangement according to the invention has an extent suited to be built into a hearing device. The antenna arrangement converts electromagnetic radiation into wire bound electric signals and/or vice versa, so as to be operationally connectable to the input of a demodulator and/or to the output of a modulator. The antenna arrangement has a transfer characteristic magnitude larger than a predetermined value in a spectral band which has a bandwidth. An adjusting unit is provided for the bandwidth which has a bandwidth control input.

In one embodiment the antenna arrangement comprises a resonant circuit and the adjusting unit comprises at least a part of the resonant circuit.

In one embodiment of the antenna arrangement the resonant circuit is a passive circuit. Thereby the addressed bandwidth is e.g. in a basic parallel or series resonance circuit predominantly determined by the value of parallel or series resistance which may easily be adjusted manually and/or automatically i.e. electronically.

In one embodiment of the antenna arrangement the resonance circuit comprises at least one antenna coil.

The present invention is further directed towards a hearing device which comprises an antenna arrangement for a wireless communication link as was addressed.

In one embodiment the addressed hearing device comprises a digital signal-processing unit with an output operationally connected to the addressed control input.

In a further embodiment the hearing device comprises an acoustical/electrical input converter with an output which is operationally connected to an input of the processing unit. An electrical/mechanical output converter has an input which is operationally connected to an output of the processing unit.

In a further embodiment of the invention a hearing device system is proposed which comprises at least two of the addressed hearing devices. In one embodiment such system is a binaural system and the communication link may transmit signals of different types between said devices.

Still in a further embodiment at least one of the antennas provided in the devices of the addressed system establishes a communication link to a further device.

These addressed hearing devices may be behind-the-ear, in-the-ear or completely-in-the-canal hearing devices with increasing demand with respect to constructional compactness and minimal power consumption.

The invention shall now be further exemplified with the help of figures.

Figure 2:
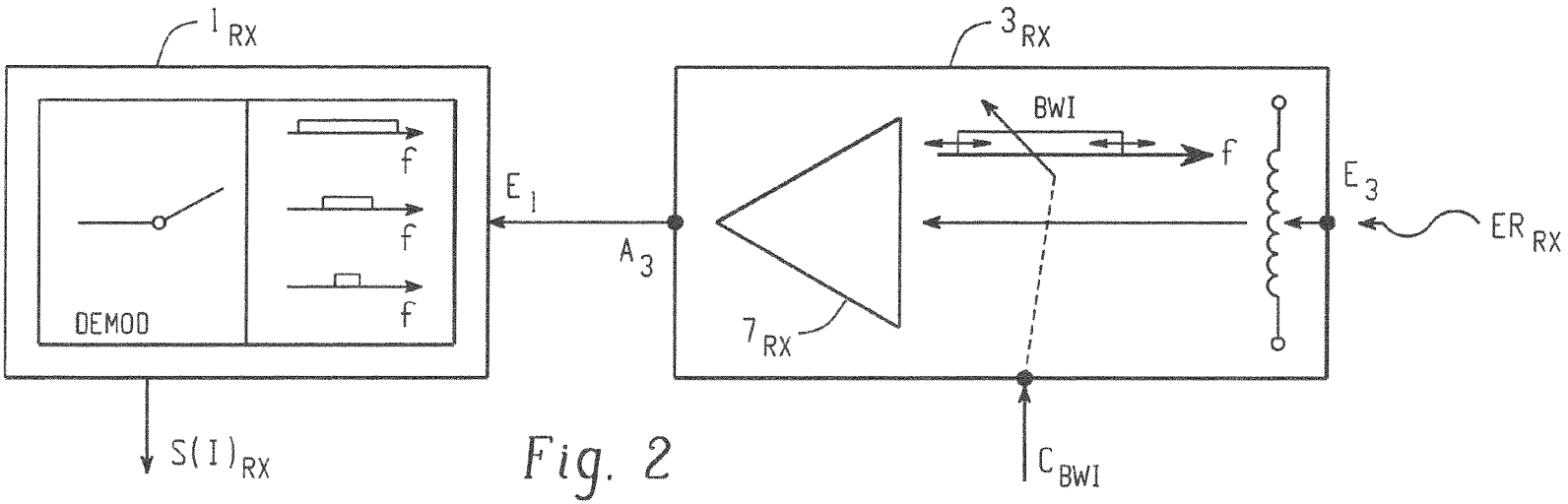
Figure 3:
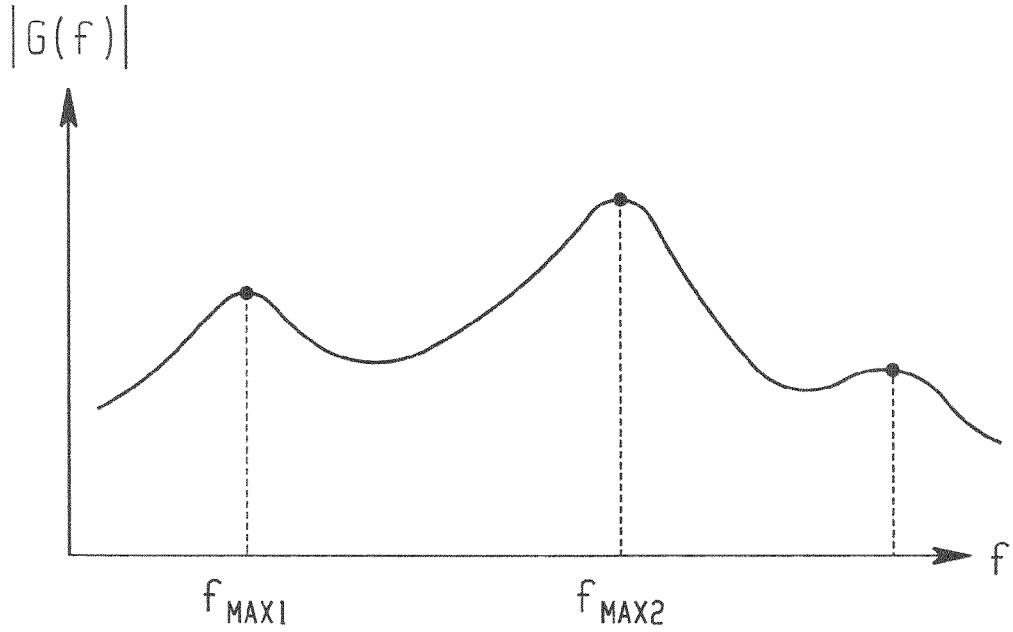
Figure 4:
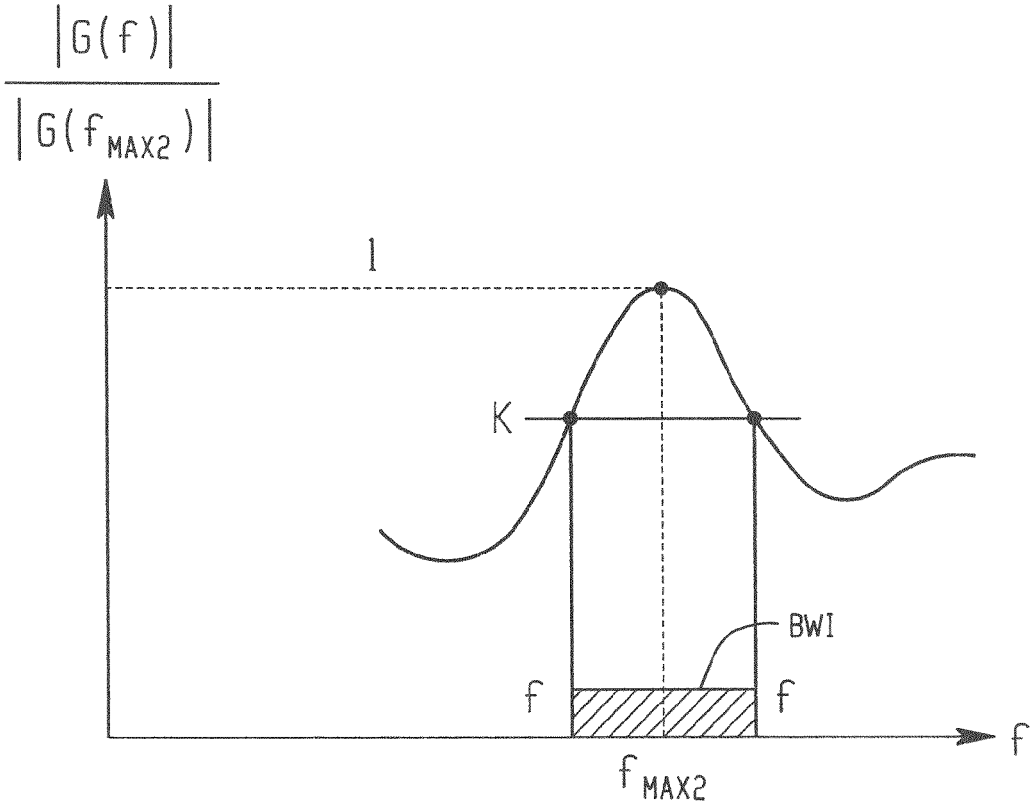
Figure 5:
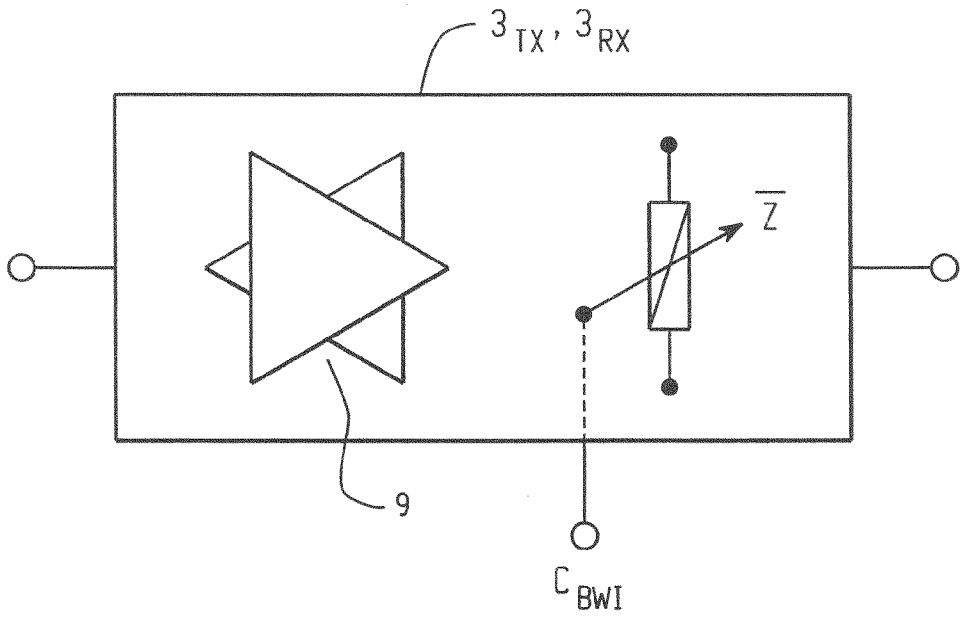
Figure 8:
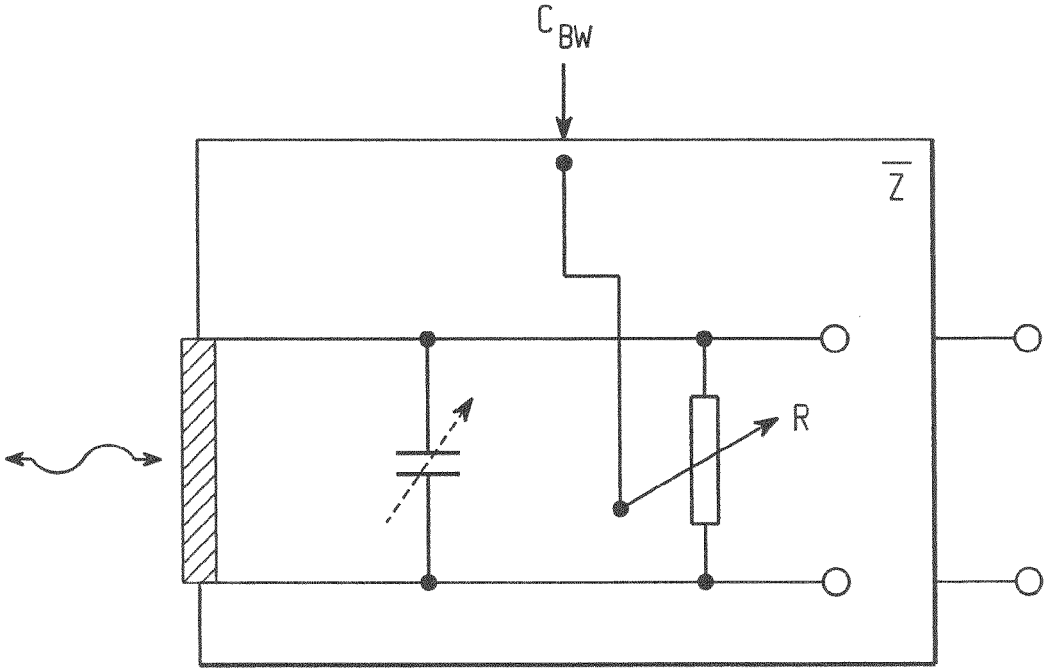
Figure 6:
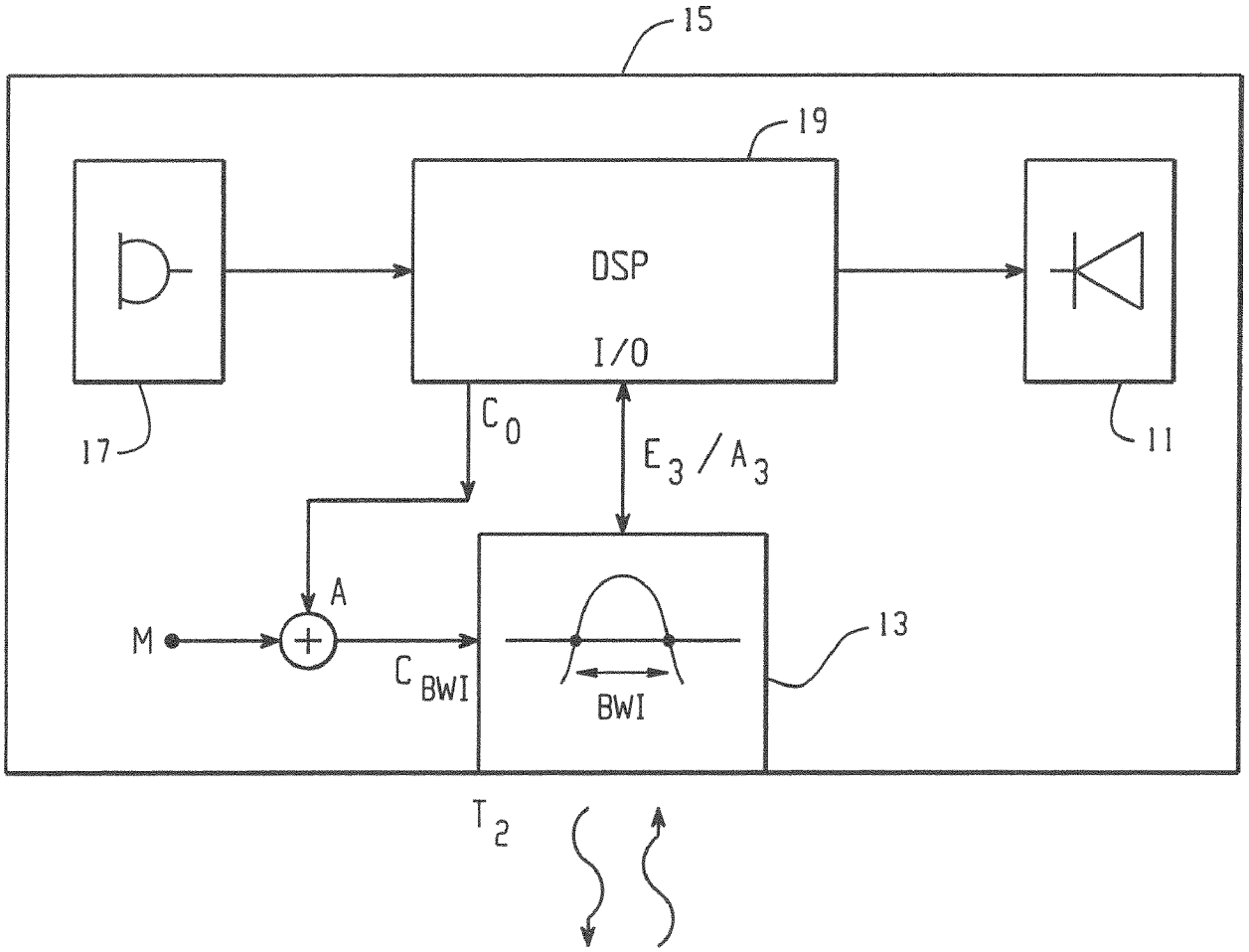
Figure 7:
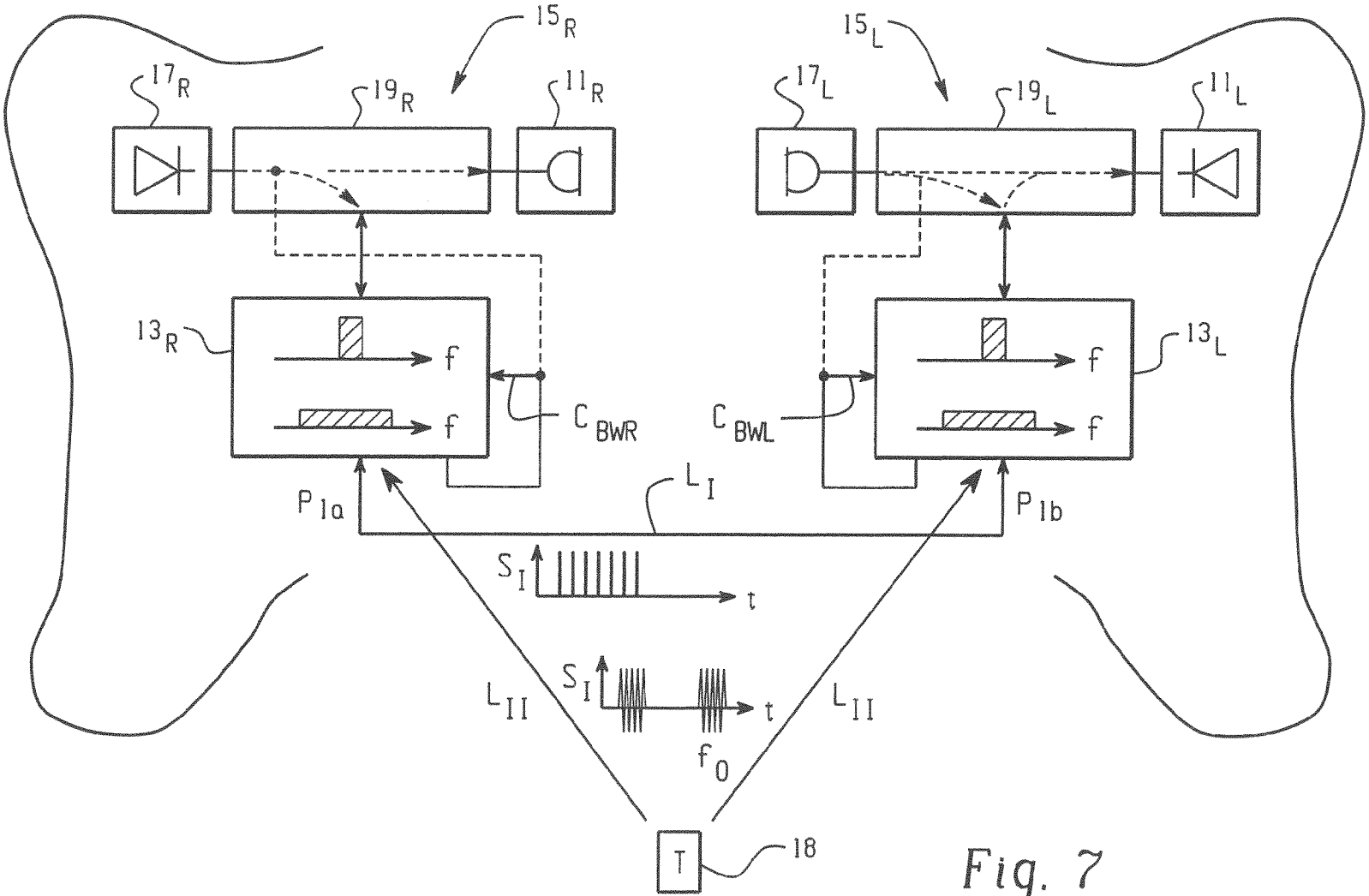

The figures show:

FIG. 1 in a simplified schematic functional-block/signal flow diagram a transmitter arrangement as provided in a hearing device according to the present invention incorporating an antenna arrangement according to the invention;

FIG. 2 in a representation in analogy to that of FIG. 1 a receiver arrangement as provided in a hearing device according to the present invention and incorporating an antenna arrangement as of the invention;

FIG. 3 qualitatively and as explaining example the graph of magnitude vs. frequency of a transfer function as possibly realized in an antenna arrangement according to the invention;

FIG. 4 a part of the magnitude graph as of FIG. 3, normalized relative to magnitude at one selected frequency;

FIG. 5 in a simplified schematic form a transmission and/or reception antenna arrangement according to the present invention representing its realization by active electronic elements on one hand and passive impedance elements on the other hand;

FIG. 6 a hearing device according to the present invention, shown schematically by means of a signal-flow/functional-block diagram with an antenna arrangement according to the invention;

FIG. 7 most schematically and simplified, a pair of hearing devices of a binaural hearing device system with different types of signal transmission enabled, and FIG. 8 departing from the representation of FIG. 5, an embodiment to adjust bandwidth of the antenna arrangement.

In the FIGS. 1 and 2 there is shown, by means of a simplified functional-block/signal flow diagram a transmitter arrangement (FIG. 1) and a receiver arrangement as provided in a hearing device according to the present invention to establish a communication link between such hearing device and at least one further device.

According to FIG. 1 the transmitter arrangement within the hearing device (not shown) comprises a modulator unit $\mathbf{1}_{TX}$ having a communication output $A_1$ operationally connected to an input $E_3$ of an antenna arrangement $\mathbf{3}_{TX}$. Signals $S(I)_{TX}$ with information I, which signals may be of quite different types e.g. audio signals, speech signals, control signals etc. are applied to the modulator unit $\mathbf{1}_{TX}$. Accordingly, the respective signal $S(I)_{TX}$ is modulated upon an electrical or optical signal, whereby in dependency of the type of such signal the output signal of the modulator $\mathbf{1}_{TX}$ will be of a different bandwidth. This is schematically shown in FIG. 1 in that by its type the signal $S(I)_{TX}$ governs the bandwidth BW of the signal output at the communication output $A_1$ and input to the antenna arrangement $\mathbf{3}_{TX}$. At the downstream end of the antenna arrangement $\mathbf{3}_{TX}$ and relative to the modulator unit $\mathbf{1}_{TX}$ the antenna arrangement 3 comprises an antenna $\mathbf{5}_{TX}$ which converts input electrical signals from the modulator unit 1 into electromagnetic radiation $ER_{TX}$ at output $A_3$. The transmitter antenna arrangement $\mathbf{3}_{TX}$ further comprises signal processing units as e.g. amplifiers, filters, converters etc. as generically represented by units $\mathbf{7}_{TX}$. Such units $\mathbf{7}_{TX}$ are interconnected between the output $A_1$ of the modulator unit and the front end antenna $\mathbf{5}_{TX}$.

FIG. 2 shows in a representation analogous to that of FIG. 1 the receiver arrangement as provided in a hearing device which, per its receiving ability, makes part of a communication link according to the present invention.

According to FIG. 2 the receiver antenna arrangement $\mathbf{3}_{RX}$ comprises an upstream antenna $\mathbf{5}_{RX}$ which receives and converts electromagnetic radiation $ER_{RX}$ at input $E_3$ towards signal processing units as schematically represented by units $\mathbf{7}_{RX}$. The output $A_3$ of the antenna arrangement $\mathbf{3}_{RX}$ is operationally connected to the input $E_1$ of a demodulator unit $\mathbf{1}_{RX}$. As schematically shown within the block of demodulator unit $\mathbf{1}_{RX}$ in dependency of the type of information signal $S(I)_{RX}$ which is carried in the signal transmitted from the antenna arrangement $\mathbf{5}_{RX}$ to the demodulator unit $\mathbf{1}_{RX}$ and of the modulation technique which was applied on the transmitter side different signal bandwidth BW is transmitted through arrangement $\mathbf{3}_{RX}$. As further schematically shown in FIG. 2 in dependency of such bandwidth of the received signal BW and spectral location thereof, a different demodulating technique may be applied as shown by the switching symbol in the demodulation block $\mathbf{1}_{RX}$. The output of the demodulator unit $\mathbf{1}_{RX}$ is an informative $S(I)_{RX}$ which in analogy to the explanations with respect to FIG. 1, may be of the audio type, of the speech type, of command type, etc.

In the transmission mode the antenna arrangement $\mathbf{3}_{TX}$ as shown has a transfer characteristic $G_{TX}(f)$, whereby f is the frequency. Accordingly, in the receiver mode as of FIG. 2 the antenna arrangement $\mathbf{3}_{RX}$ has a transfer characteristics $G_{RX}(f)$.

The transfer characteristic $G_{TX}(f)$ and $G_{RX}(f)$ may be represented by their respective magnitude vs. frequency and phase vs. frequency graphs. As schematically exemplified in FIG. 3 the respective transfer characteristics magnitude graphs $|G(f)|$ of antenna arrangements as addressed have band pass characteristics at and around one or more than one specific frequencies as shown in FIG. 3 by $f_{max1}$, $f_{max2}$ . . . .

The selectivity of the antenna arrangement in the reception—$\mathbf{3}_{RX}$—mode as well as in the transmitting—$\mathbf{3}_{TX}$—mode is given by the shape of the respective maximum area of the magnitude vs. frequency graphs $|G_{TX}|$ and $|G_{RX}|$ at and around the addressed specific frequencies $f_{max1}$, $f_{max2}$. The shape of the respective spectral maximum area at and around the addressed frequencies is given as perfectly known to the skilled artisan by the behaviour of the network within the antenna arrangement $\mathbf{3}_{TX}$, $\mathbf{3}_{RX}$ at and around pole frequencies present at second and higher order transfer characteristics.

Within the scope of the present invention it is less the absolute magnitude of the respective transfer characteristics which are of interest, but rather how the respective magnitude vs. frequency characteristics drop on both sides of the respective maxima. Therefore, it is more convenient to consider normalized magnitude functions as shown in FIG. 4.

To establish normalized magnitude graphs it is customary to normalize by the maximum magnitude in a frequency band considered. In FIG. 4 the graph of magnitude vs. frequency is standardized by $|G(f_{max2})|$ of FIG. 3.

The bandwidth BWI with a selected pole frequency $f_{max}$ of the antenna arrangement $\mathbf{3}_{TX}$ and $\mathbf{3}_{RX}$ is then defined by the spectral range along which the normalized magnitude is at least equal to a predetermined value K. It is customary to select as a value K the value $1/\sqrt{2}$ so that the bandwidth BWI is limited by the lower and upper frequencies $f_-$ and $f_+$ at which the magnitude has dropped by 3 dB relative to maximum magnitude at $f_{max}$.

According to the present invention and according to FIGS. 1 and 2 the bandwidth BWI of the respective antenna arrangement $\mathbf{3}_{TX}$ and $\mathbf{3}_{RX}$ is adjusted as schematically shown in the figures via a bandwidth control input $C_{BWI}$.

Whereas in more customary RF communication, $f_{max}$ is adjusted and possibly swept along the frequency axis so as to select different frequency bands to be transmitted or to be received, according to the present invention the primary target is to adjust the bandwidth BWI at a frequency $f_{max}$ selected which, nevertheless might be adjusted or shifted additionally. Thereby, and in dependency of the needed bandwidth BWI to optimally communicate a signal type the transmission antenna arrangement bandwidth $BWI_{TX}$ or the reception antenna arrangement bandwidth $BWI_{RX}$ are accordingly adjusted so as to be optimal for the necessitated signal bandwidth BW.

The antenna arrangement $\mathbf{3}_{TX}$ or $\mathbf{3}_{RX}$ may comprise active electronic components as of filters and amplifiers as well as passive electronic components as of resistors, capacitors and inductances.

Thus, and according to FIG. 5 the antenna arrangement $\mathbf{3}_{TX}$ and $\mathbf{3}_{RX}$ as of the FIGS. 1 and 2 comprise passive elements generically shown in FIG. 5 by the impedance element $\overline{Z}$ as well as active elements generically shown at 9. In one embodiment of the present invention the bandwidth BWI of the respective transfer characteristics $G_{TX}$, $G_{RX}$ as has been explained in context with the FIGS. 1 and 2 is adjusted by adjusting one or more than one of the passive electronic components in the antenna arrangement as addressed by the bandwidth control input $C_{BWI}$ in FIG. 5 acting on the impedance $\overline{Z}$.

The bandwidth BWI of the antenna arrangement $\mathbf{3}_{TX}$, $\mathbf{3}_{RX}$ is primarily governed by the real component of the complex transfer function $G_{TX}$, $G_{RX}$ respectively around the respective $f_{max}$. Thus, and also with an eye of FIG. 5 the bandwidth control input $C_{MWI}$ may act primarily on resistance elements in the impedance network $\overline{Z}$.

In FIG. 6 there is schematically shown how, according to the present invention a respective antenna arrangement 13 as was exemplified with the help of the FIGS. 1 to 5, is applied to a hearing device 15.

The hearing device 15 comprises an input acoustical/electrical converter unit 17, e.g. a microphone unit, the output thereof being operationally connected to an input of a digital signal processing unit DSP 19. The output of that DSP unit 19 is operationally connected to an input of an output electrical/mechanical converter 11, e.g. a loudspeaker unit. The hearing device 15 comprises the antenna arrangement 13, the electric communication port $E_3/A_3$ being operationally connected to an input and/or output I/O of unit 19, wherein with an eye on FIGS. 1 and 2 the respective modulator unit $\mathbf{1}_{TX}$ and/or demodulator unit $\mathbf{1}_{RX}$ is implemented (not shown in FIG. 6).

The antenna arrangement 13 has as was discussed a bandwidth control input $C_{BWI}$. Switching from one bandwidth to another at the antenna arrangement 13 is done manually, M, and/or automatically, A. Automatic bandwidth control A may e.g. be established by analyzing acoustical signals received at input converter 17 by the DSP unit 19, by analyzing wirelessly received signal at antenna unit 13 by the DSP unit 19, generically by DSP control.

Most generically the DSP unit 19 provides at control output $C_O$ a bandwidth control signal applied, in the automatic mode, to antenna arrangement 13 at its bandwidth control input $C_{BWI}$. Thus, whenever a control signal is applied to the control input $C_{BWI}$ of the antenna arrangement 13 operating in transmitting and/or receiver mode, this will change or adjust the bandwidth BWI so as to adapt such bandwidth to be optimally suited for receiving or transmitting signals of momentarily prevailing type.

As an example:

It has to be kept in mind that a hearing device is customarily carried at or very near to an individual's head. For wireless communication there exist severe restrictions with respect to power density of transmitted signals. Thus, for ongoing communication one will reduce the spectral power density transmitted or received as far as possible. This may lead to dealing with spectral low-power density signals necessitating very large spectral bandwidths and thus the need to operate the antenna arrangements involved at very high bandwidths, which might not be optimal for other signals to be transmitted, due e.g. to signal-to-noise consideration.

If e.g. a hearing device whereat an antenna arrangement is integrated as shown in FIG. 6 is, on one hand part of a binaural hearing device system where audio representing signals are practically permanently transmitted to and from the hearing device, and, on the other hand such hearing device is part of a long range communication link too, then it might be advisable, on one hand, to adjust the bandwidth BWI of the addressed antenna arrangement to be wide to transmit the audio-signals e.g. coded in UWB-standard and, on the other hand, to switch to narrow band-width during long range communication cycles. This is exemplified in FIG. 7.

According to FIG. 7 a first hearing device $\mathbf{15}_R$ e.g. at an individual's right ear is conceived principally as has been explained in context with FIG. 6. A second hearing device $\mathbf{15}_L$ is applied at the individual's left ear.

Both hearing devices $\mathbf{15}_R$ and $\mathbf{15}_L$ form a binaural hearing system and do communicate via their respective antenna arrangements $\mathbf{13}_R$ and $\mathbf{13}_L$. Thus there is established between the two antenna arrangements a first communication link $L_I$ which is the device-to-device binaural communication link. Via this wireless communication link $L_I$ information is transmitted practically permanently at a high rate. Thereby the respective input acoustical/electrical converters $\mathbf{17}_R$, $\mathbf{17}_L$ of the hearing devices become respectively operationally connected via the addressed communication link $L_I$ e.g. with the other ear electrical/mechanical converters $\mathbf{11}_L$ and $\mathbf{11}_R$. These signals as schematically shown in FIG. 7 at $S_I$ may be encoded and transmitted on the low-range, binaural communication link $L_I$ as short, low-energy pulses. Proper transmission of $S_I$ necessitates broad bandwidth, but, on the other hand, the spectral power density is low. For optimum transmission of such signals the antenna arrangements $\mathbf{13}_L$, $\mathbf{13}_R$ are switched into broad bandwidth mode.

Additionally to the binaural communication link $L_I$, one or both of the antenna arrangements $\mathbf{13}_R$, $\mathbf{13}_L$ may communicate via a long-distance communication link $L_{II}$ e.g. with a remote transmitter/receiver unit 18. This communication link $L_{II}$ may e.g. be based on RF modulation as schematically shown at $S_{II}$ operating on a carrier frequency $f_O$. For accurate communication on that link $L_{II}$ the one or the two antenna arrangement 13 involved in $L_{II}$ communication are switched to narrow band-width operation. The switching from one bandwidth operation to a different bandwidth operation at the respective antennas is done, as schematically shown, controlled manually or automatically as was addressed in context with FIG. 6.

In FIG. 8 there is shown, how the bandwidth of a parallel resonance circuit with antenna coil L as an inductance may be adjusted by controllably varying the value of resistance R. By the value of the parallel resistance R the quality factor Q and thus the antenna bandwidth BWI is varied.

Comparing FIG. 8 with FIG. 5 and the respective explanation reveals that in one embodiment which makes bandwidth adjustment pretty straightforward, adjusting the antenna arrangement comprises adjusting a resistance element as of R in FIG. 8 within a passive resonant circuit, wherein the antenna coil is at least part of the inductance.

This circuit is at least a front end part of the passive impedance $\overline{Z}$ as shown in FIG. 5.

It is clear that additionally to adjusting the bandwidth BWI according to the present invention and as shown in FIG. 8 by dash lines, $f_{max}$ i.e. resonance frequency may be varied and adjusted as by adjusting the value of capacitance C.

By adjusting the bandwidth of an antenna arrangement at a hearing device to the respective needs of different types of signal-transmission considerable savings with respect to signal-power and improvements of signal-to-noise ratio and thus of accurate transmission of information are reached.

The invention claimed is:

1. A method of making a wireless communication link between a hearing device and at least one further device, said hearing device comprising:

A demodulator and/or a modulator, respectively with a communication input and a communication output Said input and/or output being operationally connected to a respective antenna arrangement converting input electromagnetic radiation into wire bound electric communication signals and vice versa respectively, Said antenna arrangement having a transfer characteristic magnitude larger than a predetermined value in a spectral band having a bandwidth about a pole frequency, comprising the step of adapting said bandwidth about said pole frequency to the specific type of momentary established signal transmission or of signal transmission to be established next, wherein said communication link is made at least between the hearing devices of a binaural hearing device system, and wherein when the hearing devices communicate with each other, the bandwidth is a wide bandwidth centered about said pole frequency, and wherein the step of adapting said bandwidth about said pole frequency includes switching to a narrower bandwidth centered about said pole frequency.

2. The method of claim 1 wherein said antenna arrangement comprises a passive antenna unit and said adapting said bandwidth comprises adjusting transfer characteristic of said passive antenna unit.

3. The method of claim 1 comprising automatically recognizing said specific type and automatically adapting said bandwidth.

4. The method of claim 1 wherein another communication link is made between a hearing device and at least one further hearing device.

5. The method of claim 1 wherein said specific types comprise at least one of:

Audio signal transmission;
Speech transmission;
Music transmission;
Command or control signal transmission;
Wide- or ultra wide band transmission;
Narrow- or ultra narrow band transmission;
Low range transmission;
Medium range transmission;
Long range transmission.

6. The method of claim 1 wherein the location of said pole frequency is maintained during the step of adapting said bandwidth about said pole frequency.

7. A hearing device system comprising at least two hearing devices forming a binaural hearing device system including a wireless communication link transmitting signals between said at least two hearing devices, the hearing device system including antenna arrangements such that each of said at least two hearing devices comprises an antenna arrangement with an extent suited to be built into a hearing device, said antenna arrangement converting electromagnetic radiation into wire bound electric signals and/or vice versa, so as to be operationally connectable to the input of a demodulator and/or to the output of a modulator and having a transfer characteristic magnitude larger than a predetermined value in a spectral band having a bandwidth about a pole frequency, comprising an adjusting unit for adjusting said bandwidth about said pole frequency with a bandwidth control input, at least one of said antenna arrangements establishing a communication link to a further device, and wherein when the hearing devices communicate with each other, the bandwidth is a wide bandwidth centered about said pole frequency, and wherein said at least one of said antenna arrangements establishing a communication link to a further device adjusts said bandwidth by switching to a narrower bandwidth centered about said pole frequency.

8. The hearing device system of claim 7, wherein said antenna arrangement includes a resonant circuit, said adjusting unit comprising at least a part of said resonant circuit.

9. The hearing device system of claim 8 wherein said resonant circuit is a passive circuit.

10. The hearing device system of claim 8 wherein said resonant circuit comprises at least one antenna coil.

11. The hearing device system of claim 7, wherein each of said at least two hearing devices comprises a digital signal processing unit with an output operationally connected to said bandwidth control input.

12. The hearing device system of claim 11 wherein each of said at least two hearing devices comprises an acoustical/electrical input converter with an output operationally connected to an input of said processing unit, an electrical/mechanical output converter with an input operationally connected to an output of said processing unit.

13. The hearing device system of claim 7 wherein the location of said pole frequency is maintained during said adjusting said bandwidth about said pole frequency.

* * * * *